US008353086B2

(12) United States Patent
Pike

(10) Patent No.: US 8,353,086 B2
(45) Date of Patent: Jan. 15, 2013

(54) RING CLING

(75) Inventor: Meredith Evin Pike, Draper, UT (US)

(73) Assignee: Meredith Pike, Draper, UT (US)

( * ) Notice: Subject to any disclaimer, the term of this patent is extended or adjusted under 35 U.S.C. 154(b) by 14 days.

(21) Appl. No.: 12/725,267

(22) Filed: Mar. 16, 2010

(65) Prior Publication Data

US 2010/0229348 A1 Sep. 16, 2010

Related U.S. Application Data

(60) Provisional application No. 61/210,021, filed on Mar. 16, 2009.

(51) Int. Cl.
*A45C 11/16* (2006.01)

(52) U.S. Cl. ..... 24/3.7; 24/3.5; 24/3.11; 24/3.12; 206/815; 206/5; 206/6.1

(58) Field of Classification Search ..... 24/3.5, 24/3.7, 3.11, 3.12; 206/0.815, 5, 6.1
See application file for complete search history.

(56) References Cited

U.S. PATENT DOCUMENTS

| | | | | | |
|---|---|---|---|---|---|
| D239,986 | S * | 5/1976 | Artz | D3/226 |
| D307,673 | S * | 5/1990 | Brown | D3/218 |
| 5,008,984 | A * | 4/1991 | Levy | 24/303 |
| 5,123,525 | A * | 6/1992 | Orlowski | 206/5 |
| 5,187,691 | A * | 2/1993 | Oehme et al. | 367/134 |
| 5,499,429 | A * | 3/1996 | Higginbotham | 24/3.11 |
| 5,829,102 | A * | 11/1998 | Conti | 24/3.12 |
| 5,893,497 | A * | 4/1999 | Schaiewitz | 224/182 |
| 5,924,558 | A * | 7/1999 | De Mayo | 206/5 |
| 6,164,442 | A * | 12/2000 | Stravitz | 206/233 |
| 6,640,398 | B2 * | 11/2003 | Hoffman | 24/303 |
| 7,200,897 | B2 * | 4/2007 | Silvestro | 24/3.3 |
| 7,526,842 | B2 * | 5/2009 | Wemmer | 24/578.13 |
| 2004/0250382 | A1 * | 12/2004 | Collins et al. | 24/3.12 |
| 2008/0172841 | A1 * | 7/2008 | Babasaki | 24/3.12 |
| 2009/0054814 | A1 * | 2/2009 | Schnapp et al. | 600/595 |
| 2009/0071057 | A1 * | 3/2009 | Hoyt | 43/42.31 |

* cited by examiner

*Primary Examiner* — Robert J Sandy
*Assistant Examiner* — David Upchurch

(57) ABSTRACT

A small pouch for holding/storing jewelry. This pouch is made of a flexible rubber material with a small, linear slit in the top of the device. The pouch is created in order to hold or store different articles of jewelry. The purpose of the linear slit is to allow the jewelry to enter/exit the device. Attached to this, is a small metal clip. The metal clip allows the device to be secured to different articles of clothing. The metal clip contains a small metal bead which can bounce around within the clip, thereby causing a rattling sound. The purpose of this is to alert the user of the device's presence, therefore reminding them of the jewelry that has been stored within the rubber pouch.

6 Claims, 4 Drawing Sheets

RING CLING

CROSS REFERENCE

Provisional Patent Application No. 61/210,021 filed Mar. 16, 2009

STATEMENT REGARDING FEDERALLY SPONSORED RESEARCH OR DEVELOPMENT

Not Applicable

REFERENCE TO SEQUENCE LISTING, A TABLE, OR COMPUTER PROGRAM LISTING COMPACT DISC APPENDIX

Not Applicable

BACKGROUND OF THE INVENTION

The inventor works in the healthcare industry and is involved in surgeries/procedures in which the wearing of jewelry is not allowed. Frustrated with constantly taking off and potentially losing her jewelry, she decided to make a pouch for which to hold her jewelry safely. Although the Ring Cling may have many uses, it is mostly meant for surgeons, nurses, physician assistants, and all other health care personnel that may need to remove jewelry on a daily basis.

BRIEF SUMMARY OF THE INVENTION

The Ring Cling is an invention that relates to a clothing accessory which is attachable to an article of clothing. More particularly, the invention relates to a clothing accessory which will store a ring or a small piece of jewelry, such as a wedding band, earrings, or a necklace. The accessory is attachable by use of a clip which can fasten to a shirt, pants, hat, or collar area. This clip is composed of metal material and contains a a small metal bead. The objective of the metal bead is to make the user aware of the device's presence.

The invention is composed of a modeled rubber material in the shape of a square, cube rectangle, heart, star or circle or any other shape that may be warranted. There is a small slit on the top of the apparatus which allows for the entrance/exit of the stored jewelry. Upon storage, the rubber apparatus closes, due to the material properties of the rubber and can secure the piece of jewelry obtained.

The objective of the invention is to provide a holder for jewelry as described above. The clothing clip is to be attached to the back of the rubber material securely. A further objective of the invention is to provide a decorative holder of which the holder can be used as a fashionable device of the clothing.

DETAILED DESCRIPTION OF THE INVENTION

Figure 1:
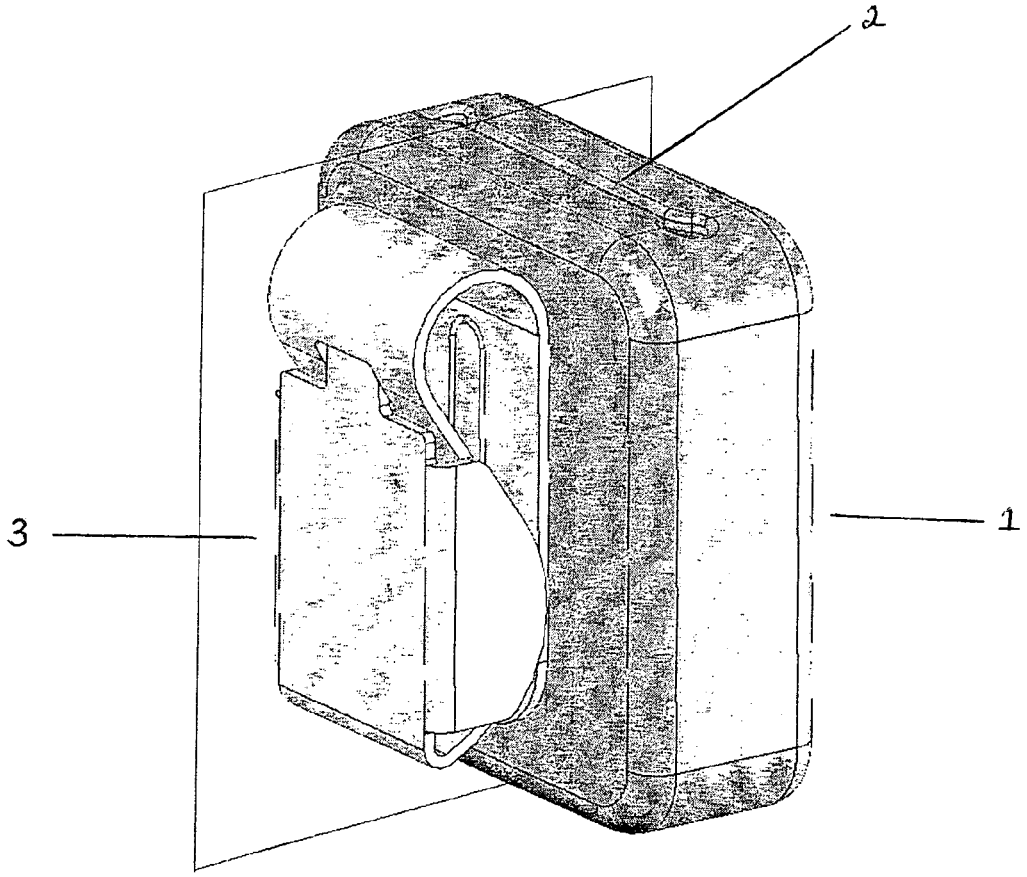
FIG. 1: An isometric view of the apparatus, showing the details of the clip.
Figure 2:
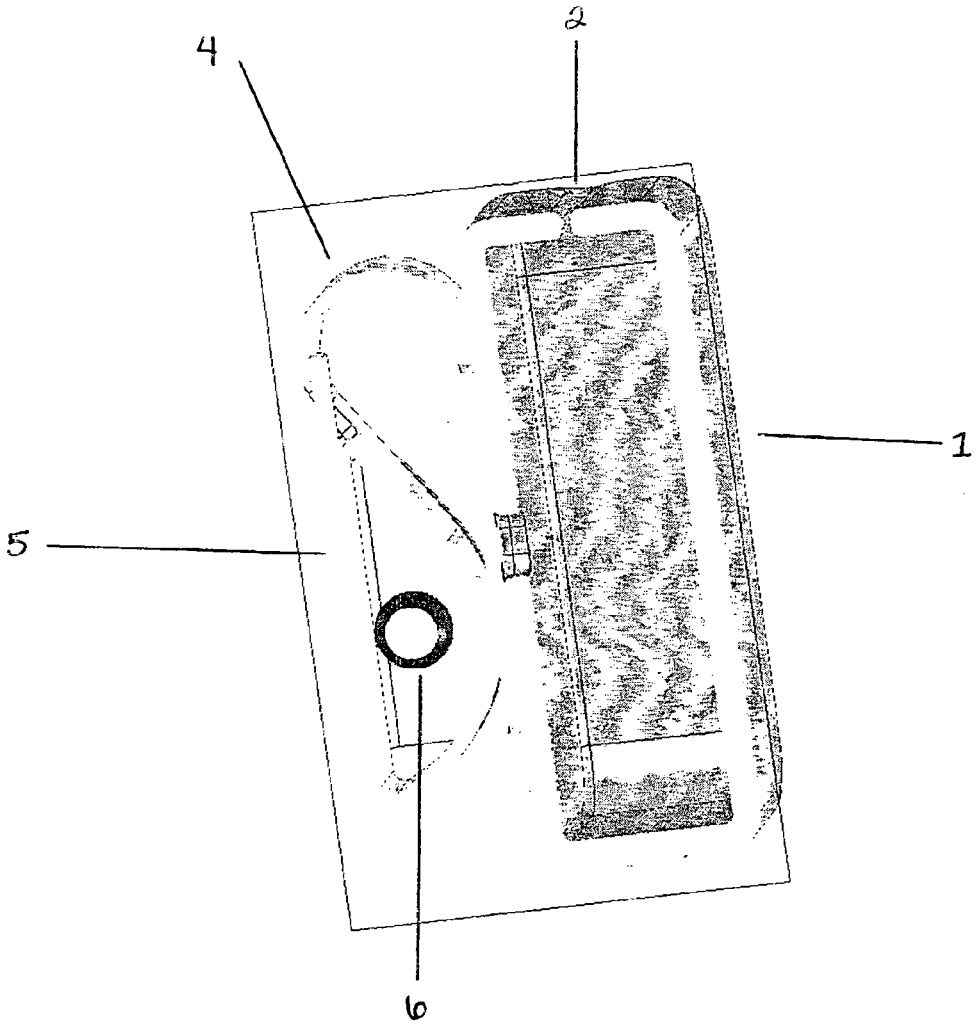
FIG. 2: A cross sectional view of the apparatus, showing the metal bead located inside of the clip and an empty interior of the pouch.
Figure 3:
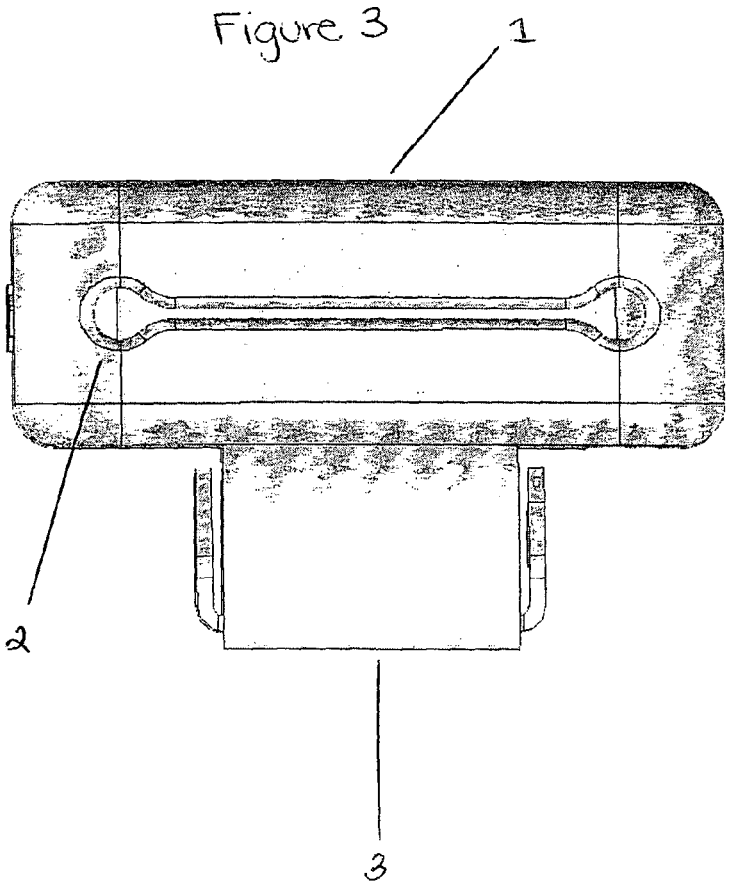
FIG. 3: A top view of the apparatus, demonstrating the slit for which to insert the jewelry piece. Note the rounded edges of the slit ends to prevent cracking in the material.
Figure 4:
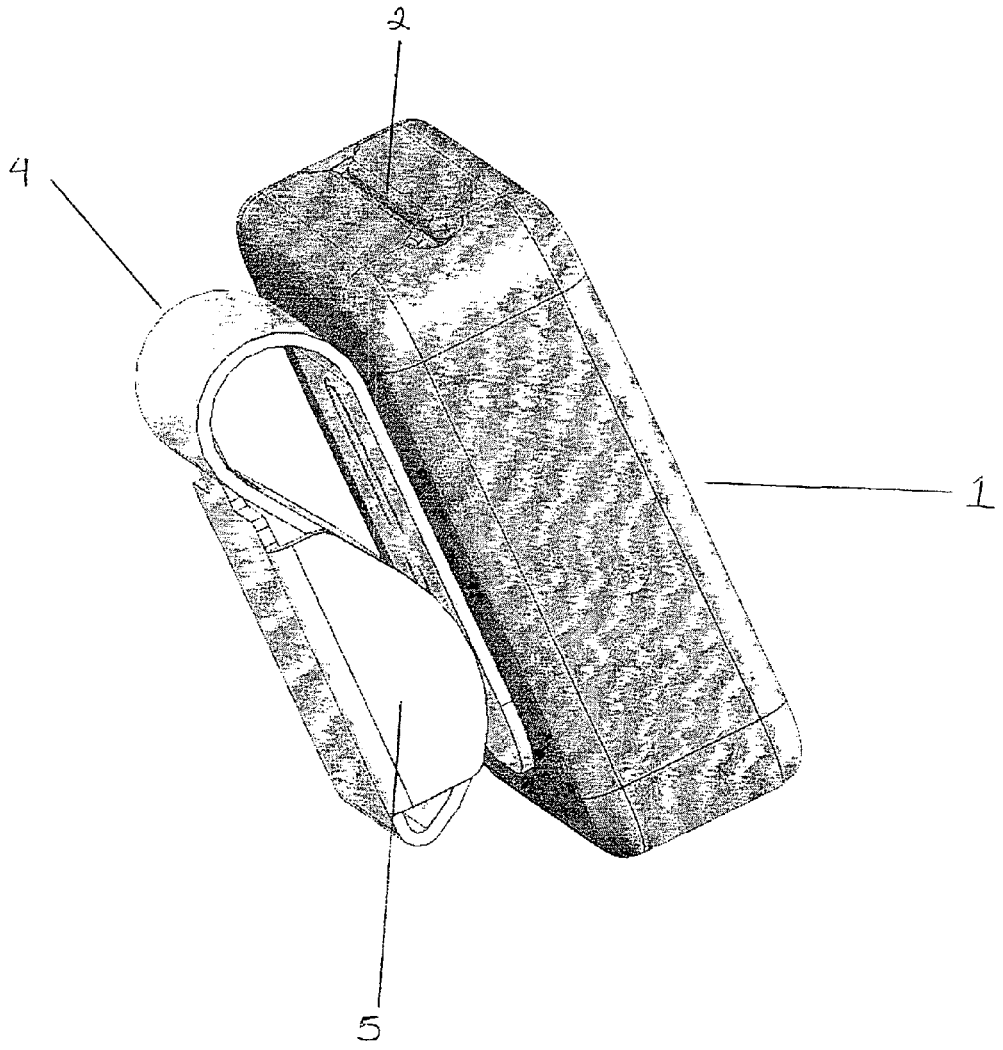
FIG. 4: An isometric view of the apparatus.

The invention is a device meant for holding or storing jewelry, and more specifically, a ring, earrings, or a small necklace/bracelet. The device is a small pouch (Reference #1) that is made of a rubber material which is flexible. There is a small slit at the top of the device (Reference #2) which is closed in it's resting state, however, when pressure is applied to the sides of the device, the slit opens in order to place the jewelry inside. There is a small metal clip (Reference #3) attached to the rubber pouch which is meant for fastening the device onto clothing. This metal clip holds a dual purpose. The first portion of the clip is an "s-shaped" portion (Reference #4) which allows the clip to remain fastened to an article of clothing. The second portion is comprised of the metal folding back on itself to create a housing unit (Reference #5) for a small metal bead (Reference #6). This portion of the invention is imperative, as this allows the clip to make noise, and therefore alerts the user to the device's presence.

This device is original, however it may be viewed as an improvement on an existing device. It is similar in function and material to a change purse that is rubber and is meant for holding/storing money. What distinguishes this invention from all other similar inventions, however, is the fact that it is meant for holding/storing jewelry, and more specifically, for storing jewelry for health care personnel who are required to scrub for surgical procedures and cannot wear their jewelry on their hands. It is also different in two other ways. First, it has a metal clip which allows the device to be fastened to a piece of clothing, whether it be pants or shorts, a shirt collar, or a hat. Secondly, it has a small metal bead within the clip, which alerts the user as to it's presence. This therefore avoids losing the device (and subsequently the jewelry), and/or washing the jewelry in the washing machine with the article of clothing.

I claim:

1. A holder for jewelry, comprising:

a small pouch;

a small linear slit on the pouch;

a metal clip attached on the small pouch for attaching the holder onto a user's clothing; and a small metal bead within the metal clip to make noise, for alerting the user to the presence of the holder.

2. The holder of claim 1, wherein the pouch is made of a flexible rubber material.

3. The holder of claim 2, wherein the linear slit is closed in the resting state.

4. The holder of claim 3, wherein the linear slit opens when pressure is applied to either side of the pouch.

5. The holder of claim 1, wherein the clip contains an s-shaped portion, and a portion wherein the metal folds back on itself.

6. The holder of claim 5, wherein the portion of the clip that folds back on itself defines a space which contains the small metal bead.

* * * * *